US008608474B2

(12) United States Patent
Markert et al.

(10) Patent No.: US 8,608,474 B2
(45) Date of Patent: Dec. 17, 2013

(54) RECOIL IMPULSE GENERATOR FOR A WEAPON SIMULATOR

(75) Inventors: Martin Markert, Meiningen (DE); Josef Muellner, Plzen (DE); Bjoern Bonitz, Ilmenau (DE)

(73) Assignee: E.Sigma Technology AG (DE)

( * ) Notice: Subject to any disclaimer, the term of this patent is extended or adjusted under 35 U.S.C. 154(b) by 90 days.

(21) Appl. No.: 13/148,972

(22) PCT Filed: Feb. 8, 2010

(86) PCT No.: PCT/EP2010/051502
§ 371 (c)(1),
(2), (4) Date: Aug. 11, 2011

(87) PCT Pub. No.: WO2010/092020
PCT Pub. Date: Aug. 19, 2010

(65) Prior Publication Data

US 2011/0318715 A1 Dec. 29, 2011

(30) Foreign Application Priority Data

Feb. 11, 2009 (EP) ..... 09152527

(51) Int. Cl.
*F41A 33/00* (2006.01)

(52) U.S. Cl.
USPC ..... 434/18; 434/11

(58) Field of Classification Search
USPC ..... 434/11–27; 463/52; 124/45, 48, 72–76
See application file for complete search history.

(56) References Cited

U.S. PATENT DOCUMENTS

| | | | |
|---|---|---|---|
| 2,472,002 | A | 5/1949 | Clark |
| 3,427,925 | A | 2/1969 | Horn |
| 2008/0155875 | A1 | 7/2008 | Iwasawa |

FOREIGN PATENT DOCUMENTS

| | | | |
|---|---|---|---|
| DE | 2726396 | | 12/1986 |
| DE | 3631262 | | 3/1988 |
| DE | 10350307 | A1 | 5/2005 |
| EP | 1043561 | A2 | 10/2000 |
| GB | 466 870 | | 6/1937 |

OTHER PUBLICATIONS

Marshall et al., United States Statutory Invention Registration No. H186, Published Jan. 6, 1987, entitled Recoil Simulator for Weapons.

*Primary Examiner* — Timothy A Musselman
(74) *Attorney, Agent, or Firm* — Mayer & Williams, PC; Karin L. Williams, Esq.

(57) ABSTRACT

The invention relates to a recoil impulse generator for a weapon simulator comprising a force storage element and an impulse mass that can be moved and that is moved from a stressed to an unstressed position with a triggering element is actuated in order to simulate a recoil impulse. The recoil impulse generator comprises a drive that drives a spindle uninterruptedly during a shot sequence simulating several shots; a coupling that is connected to the impulse mass and to the force storage element and that engages in the spindle in an engaged state and that is moved along the spindle by means of rotation of the spindle in order to bring the impulse mass into the stressed position again the force applied by the force storage element; a disengaging means that switches the coupling to a disengaged state when the impulse mass has reached the stressed position; and an engaging means that switches the coupling to the engaged state when the impulse mass has reached the unstressed position.

16 Claims, 5 Drawing Sheets

RECOIL IMPULSE GENERATOR FOR A WEAPON SIMULATOR

CROSS-REFERENCE TO RELATED APPLICATIONS

This application is a national stage application of PCT/EP2010/051502, filed Feb. 8, 2010, which claims priority to European application no. 09152527.9, filed Feb. 11, 2009, the entirety of which is hereby incorporated by reference.

BACKGROUND OF THE INVENTION

The present invention concerns a recoil impulse generator for a weapon simulator comprising a force storage element and a movable impulse mass that is moved from a stressed to an unstressed position when a trigger element is actuated by the force storage element in order to generate a recoil impulse. In general the recoil of the most varied weapons can be simulated with a recoil impulse generator. The recoil impulse generator considered here is suitable preferably for hand gun simulators.

US 2008/0155875 A1 describes a mechanism for the recoil impulse generation in a toy gun. There an electric motor drives a piston of a compressed air cylinder via a multi-part reduction gear. The return of an impulse mass is effected by pneumatic means.

From DE 27 26 396 C2 a device is known for the simulation of the recoil force of a weapon. For this purpose a recoil generator is provided that is structurally separate from the weapon and that transfers an adjustable recoil force to the barrel of the weapon. Because of the structural size the device has to be permanently installed at a shooting range and is particularly suitable for coupling to rifles. The handling characteristics of the weapon change significantly due to the external lever action that is acting on the rifle, so that the shooting simulation corresponds only in part to the actual circumstances during use of the weapon.

DE 36 31 262 A1 describes a device for the shooting simulation of a hand gun. The bolt in the hand gun simulator is moved for that purpose by means of electromagnetic or gas pressure-activated drive means against the force of the recoil spring into the open position. In this constellation either strong drive elements have to be used or the recoil force that can be generated is too small. The generation of large recoil simulation forces would require a very strong electromagnet, which structurally could barely be accommodated in a hand gun and additionally would have a high energy consumption. If instead a gas pressure cartridge is used as drive means, it would have to be frequently exchanged if it were used to provide realistic forces. The attachment of a gas pressure cartridge to the front part of the barrel of the hand gun, as it is proposed in the printed specification, also prevents the simultaneous disposition of a target system on the front barrel section, which likewise is required for a complete hand gun simulator.

DE 103 50 307 A1 demonstrates a simulation device for the simulation of the semi- or fully automatic function of a firearm. For example, a propellant container that is disposed in the breech block is connected to a cylinder and propels a movable piston via a valve. Here also the actually achievable recoil forces are significantly lower than those associated with an actual shot because the forces that can be exerted are not as large as those that arise during the firing of a cartridge, due to the limited propellant amounts.

In EP 1 043 561 A2 a weapon simulator is described that can be used in particular in a battle tank. Here a slide serves the purpose of transporting a training projectile. The slide is driven by two parallel spindles.

U.S. Pat. No. 2,472,002 describes a screw- and self-holding mechanism that can be used for example in an airplane-machine gun and is used for re-cocking the weapon after it has malfunctioned. The mechanism uses a spindle that is driven by an electric motor, an impulse mass and a coil spring as a force storage element. A coupling is formed by the housing that feeds bearing spheres into the spindle in order to be axially displaced. The coupling is disengaged when the impulse mass has been moved into the stressed position, and engaged when the impulse mass has returned into the unstressed position. The described mechanism is only used occasionally to cock the weapon since firearm malfunctions occur only occasionally, so that the motor also is not designed for permanent use.

SUMMARY OF THE INVENTION

It is therefore the object of the invention at issue to provide an improved recoil impulse generator for a weapon simulator that generates realistic recoil forces and at the same time avoids the disadvantages of prior art. In particular the frequent replacement of propellant cartridges is to be avoided. Likewise undesirable high electromagnetic fields, as they are generated by strong electromagnets, should be avoided. In addition the weapon simulator should not exceed the dimensions, weight, balance, and the shape of an actual weapon, in particular not a hand gun, and it should provide sufficient space for installing a target-finding or target-acquisition unit despite the installation of the recoil impulse generator. Finally the recoil impulse generator should be universally adaptable to different firearm simulators so that pistols, long guns as well as also other weapons that generate recoil can be equipped therewith.

The stated objective is met using a recoil impulse generator for a weapon simulator with the characteristics stated in claim 1.

According to the invention the recoil impulse generator uses a drive, for example an electric motor, that continuously drives a spindle during a shot sequence that simulates several shots, such that via said spindle a coupling as well as a connected impulse mass are moved from the unstressed position to the stressed position, while simultaneously the force storage element is tensioned, which can be implemented for example as a trigger spring, pneumatic element, fly wheel or similar. In what follows a slide of a hand gun, which together with the coupling represents the moving mass that generates the simulated recoil impulse, is considered as a typical example of an impulse mass. In other embodiment forms other parts can form the impulse mass. For the displacement of the slide into the stressed position the coupling engages the spindle, in the engaged state and in a preferably rotationally movable manner, so that it is moved during the rotation of the spindle along the same, as it is commonly known in the case of a linear drive. The coupling is switched to a disengaged state by a disengaging means as soon as the slide has reached the stressed position. During the actuation of the trigger element, which is for example implemented by a trigger, the force storage element accelerates the slide and the disengaged coupling that is attached to it (together with the impulse mass) preferably in a direction opposite the shooting direction. This acceleration and in particular the slide striking in the unstressed position simulate the recoil force realistically. Finally an engaging means is available that switches the coupling into the engaged state again as soon as the slide has reached the unstressed position, in order to again place it in the stressed position in preparation for a further shot simulation.

The electric motor is preferably a brush-less synchronous motor that can achieve high rotational speed (approximately 20,000 min-1 to 80,000 min-1). In a preferred embodiment the electric motor can be coupled to the spindle via a transmission or it can also operate as a transmission-less direct drive. The transmission is implemented for example with a reduction ratio of 2:1 to 5:1 and can effect an inversion of rotation. It is of importance that a relatively high rotational speed of the spindle (or a high torque at lower rotational speed) is achieved in order to convey the slide from the unstressed position into the stressed position in a short time. This time corresponds to the duration of automatic reloading in the case of semi-automatic hand guns and should preferably require less than one second. In order to simulate such fast reloading times the electric motor is continuously operated during a shot sequence according to the invention, so that the drive forces act immediately on the slide while the coupling engages. This additionally has the advantage that the startup torque that necessarily acts on the hand gun simulator and which arises during startup and braking of the electric motor, no longer appears, or at least to a lesser degree, during the shot sequence, as a result of which targeting errors are avoided or reduced. A symmetrically constructed coupling serves the same purpose in a modified embodiment, wherein it engages the spindle from two facing sides so that the resulting moments are largely compensated.

In a particularly preferred embodiment the rotational speed of the electric motor can be reduced while the coupling is not engaging the spindle. The forces that arise while engaging under load and the associated wear can be significantly reduced thereby.

Likewise an embodiment is useful that uses two oppositely rotating spindles that simultaneously engage the coupling. Using a corresponding thread design the coupling is axially displaced by both threaded spindles, while arising moments compensate one another.

According to a modified embodiment form the recoil impulse generator encompasses one or several sensors that acquire the actual position of the slide or the impulse mass, the coupling, and the trigger or the trigger element. Using the analysis of the sensor signals the sequence can be controlled in the recoil impulse generator and certain particular shooting situations can be simulated, such as for example an empty magazine or a firearm malfunction.

Additional advantages, details and further improvements are specified in the following description of a preferred embodiment of the recoil impulse generator according to the invention, in reference to the drawing.

DETAILED DESCRIPTION OF THE INVENTION

Figure 1:
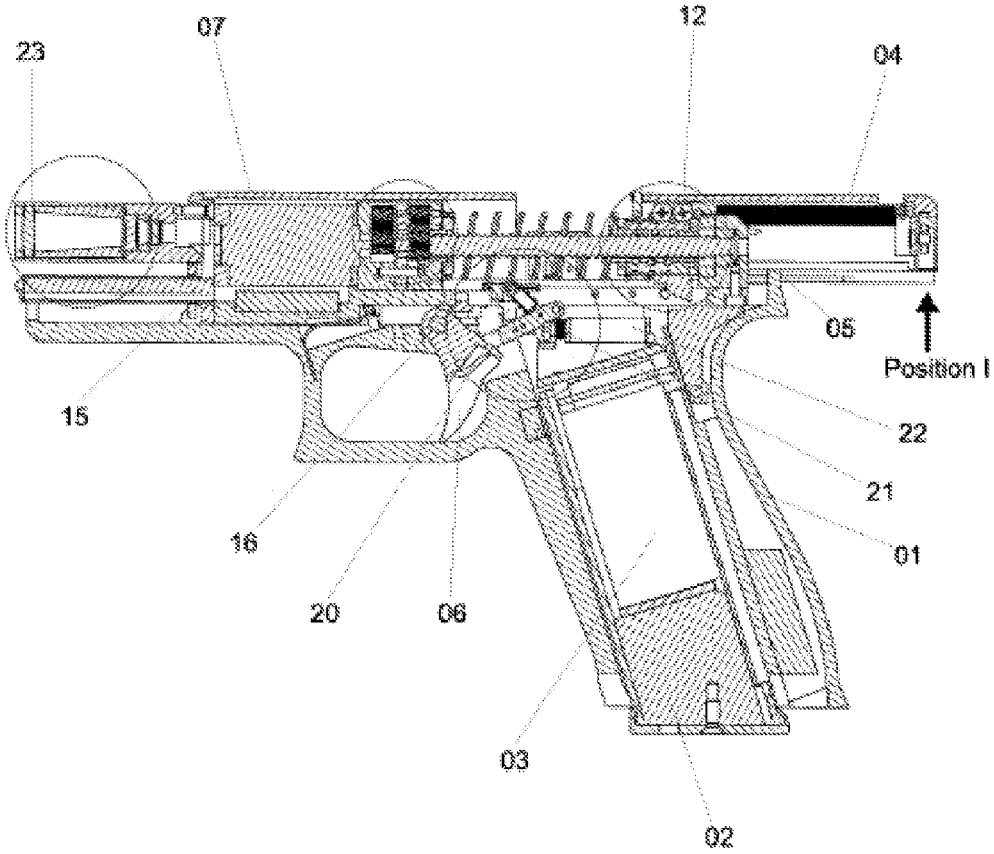
FIG. 1 is a lateral cut view of a hand gun simulator with a recoil impulse generator according to the invention in an unstressed position.

FIG. 1 displays a cut view of a hand gun simulator that is as accurate a reproduction in shape and dimensions of an actual hand gun (in this case a pistol) as possible in order to be able to design the simulation as realistically as possible. The simulator encompasses a pistol housing with a hand grip 01, wherein a magazine slot is provided. A simulator magazine 02 is inserted in the magazine slot instead of the usual cartridge magazine and it contains for example a storage battery 03 as an energy source. Furthermore a slide 04 is provided that glides along the slide-way 05 in the shooting direction and is part of the impulse mass. Furthermore the hand gun simulator encompasses a trigger 06 and a barrel 07. The recoil impulse generator is disposed in the axial direction of the barrel 07.

Figure 2:
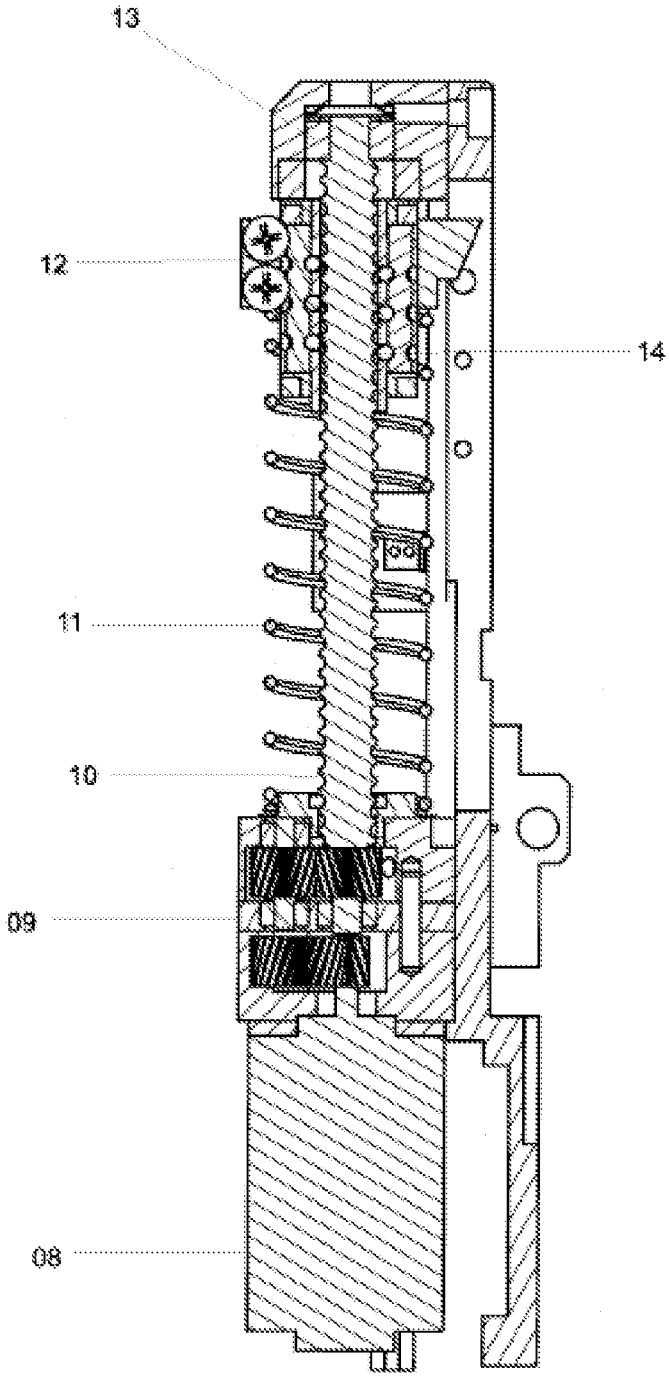
FIG. 2 is a detailed cut view of the recoil impulse generator.

FIG. 2 displays a detail representation of the most important elements of the recoil impulse generator in a cut view. An electric motor 08 that is used as a drive and that operates for example at 50,000 revolutions per minute is coupled via a transmission 09 to a spindle 10 in order to propel it to rotate. The transmission 09 can produce a reduction ratio of, for example, 3:1, so that the spindle is still driven at a high rotational speed of about 10,000 m-1 while at the same being able to generate the necessary forces to cock the latch spring 11 that acts as a force storage element. In a preferred embodiment the transmission 09 performs a rotation reversal, which has the advantage that the angular momentum generated by the electric motor 08, in reference to the axial alignment of the hand gun simulator, is largely compensated by the opposite angular momentum of the transmission 09 and the spindle 10. The compensation of the angular momentum can be omitted when the moved masses are small relative to the total mass of the simulator weapon.

In the displayed embodiment the latch spring 11 is implemented as a coil spring that extends around the spindle 10 and runs between the transmission 09 and the coupling 12. Other force storage elements can likewise be used. Modified combinations of drive and storage element can be used in other embodiments, such as for example a direct drive, a pneumatic drive, or an electromagnet with a capacitor or a storage coil.

The slide 04 is attached to the coupling 12, so that it is moved along during an axial displacement of the coupling 12. The end of the spindle 10 facing away from the transmission 09 is supported by a spindle bearing 13 that is fixed to the housing.

In FIGS. 1 and 2 the coupling 12 and the slide 04 attached to it are in the unstressed position I, in which the coupling 12 is positioned away from the transmission 09 and the latch spring 11 is largely unstressed.

Figure 3:
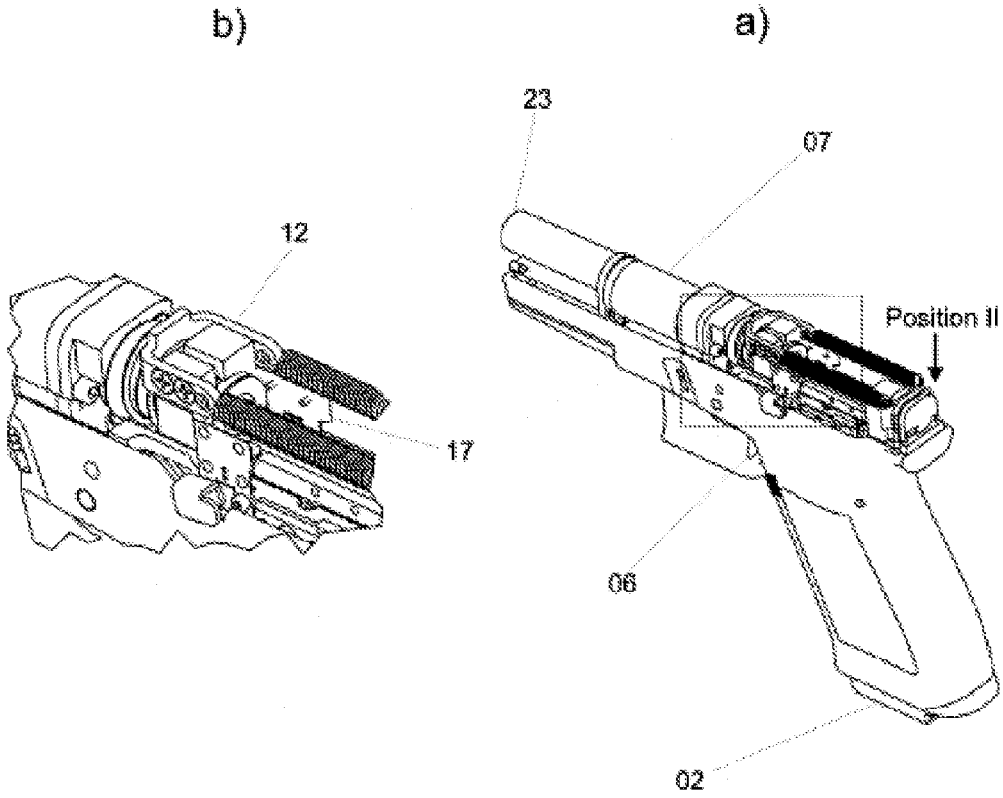
FIG. 3 is a lateral cut view of the hand gun simulator with the recoil impulse generator in a stressed position as well as a perspective detail view of a tripping square in the moment of the release of the coupling during activation of the trigger.

FIG. 2 displays the coupling 12 in the engaged state, in which several spheres 14 engage the spindle 10. Modified engagement elements, such as for example cones or pins, can be used instead of the spheres 14. When the spindle 10 is rotated, an axial movement of the coupling 12 is effected in the direction toward the transmission 09. As a result the latch spring 11 is compressed and the slide 04 is moved into a stressed position II (FIG. 3).

A first sensor 15 determines for example whether the coupling 12 has moved away from the stressed position. If this can be established, operation of the electric motor 08 commences in order to drive the spindle 10 and to again move the coupling 12 with the impulse mass coupled to it into the stressed position. As a result the movement sequence is accelerated because the motor is already being accelerated while the impulse mass is still moving in the direction of the unstressed position, in order to achieve a high cadence. Depending on the control the electric motor can be activated from a standstill or from an idle mode for this purpose and be put into a full-load condition. It is useful in order to facilitate a high shot frequency (cadence) not to turn the electric motor off after disengaging the coupling, but to instead just reduce its rotational speed and to thereby place it in an idle state. The full-load condition is then reached faster by increasing the rotational speed, in particular still during the time in which the slide is flung back from the stressed into the unstressed position. In the case of a lower cadence the motor speed can be further reduced or the motor can be turned off completely.

Coupling 12 is designed such that it engages automatically as soon as the unstressed position I is reached. The simplest approach to achieve this is via mechanical engaging means that act on the coupling during its stop in the unstressed position in order to effect the coupling of the spheres 14 to the spindle 10. The coupling is described in detail further below in reference to FIG. 5.

A second sensor 16 generates a second sensor signal as soon as the slide 04 reaches the stressed position II and the latch spring 11 is therefore cocked. At this time the coupling 12 disengages, so that the motor and the spindle can continue to rotate in idle mode without that the coupling and the slide that is attached to it are axially further displaced. The disengagement when the stressed position is reached can be implemented through the mechanical action of a disengagement means on the coupling, or it can be initiated by an actuator in reaction to the second sensor signal. Because of the disengagement the cocked state of the weapon simulator can be maintained until the next trigger (firing). At the same time the drive can continue running (if necessary at a lower rotational speed) in order to very quickly facilitate a renewed cocking after the firing. As a result individual firings as well as also sustained firings with extremely high cadence can be simulated.

FIG. 3 displays a hand gun simulator with the recoil impulse generator in the stressed position II during the moment the trigger 06 is activated (illustration a) Activation of the trigger pivots two tripping squares 17 that are disposed laterally of the coupling, as can be gathered from the detail view (illustration b), in order to release the coupling 12 that was previously blocked by these tripping squares (a retaining pawl can also be used instead of the tripping squares, or a similar element). The latch spring 11 can be released thereby and the coupling is accelerated with the slide 04 in the direction opposite to the shooting direction until the slide stops in the unstressed position I. The release of the latch spring 11, the impulse triggered by the stop of the moved masses, and the acceleration of the slide toward the front due to the immediate renewed cocking of the latch spring 11 simulate the recoil during the shot.

Figure 4:
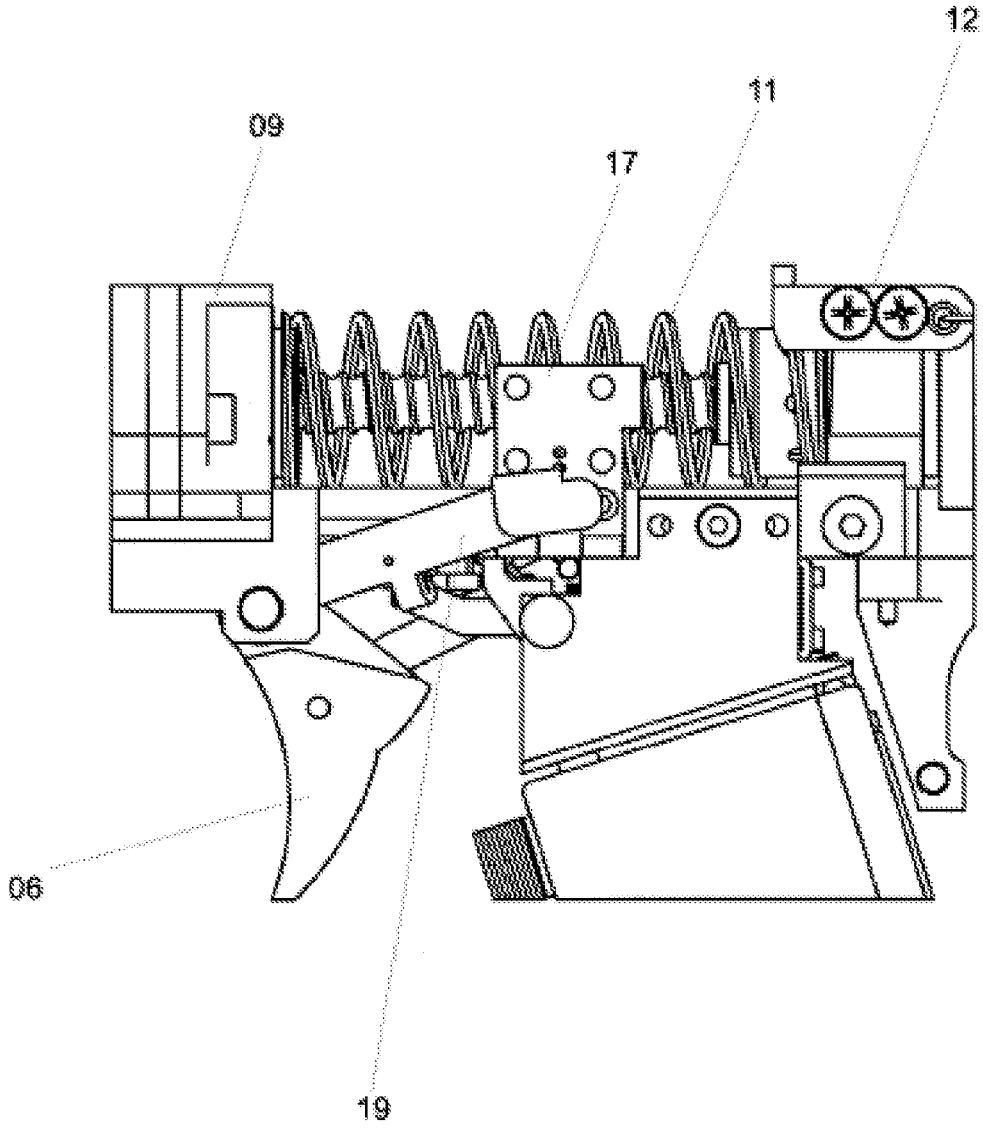
FIG. 4 is a detail view with a slide stop in an activated position.

In the detail view of FIG. 4 a slide stop 19 is shown in an activated position in which the adjustment of the tripping squares 17 for the release of the coupling 12 is prevented. For this purpose a third sensor 20 (FIG. 1) is attached in the vicinity of trigger 06, whose sensor signal indicates the discharge of the simulated shot. A control unit (not shown) can analyze the third sensor signal, for example in order to count the number of discharged shots and to activate a catch actuator 21 in the case of an "empty" magazine. The catch actuator 21 pivots the slide stop 19, which engages the slide, so that it remains in the unstressed position I, relative to the coupling position. The latch spring is cocked even when the slide remains in the unstressed position. The force storage element itself is in a stressed position. Slide stop 19 can only be manually returned into its neutral position.

A fourth sensor (not displayed) can furthermore be disposed at trigger 06 such that it detects already the starting phase of a firing, for example by acquiring the squeeze of the trigger still before the pressure point of the trigger is exceeded and the firing commences. The fourth sensor signal indicates that the firing is imminent. The electric motor can therefore for example be brought into the full-load condition early in order to be able to achieve still faster cadences.

The embodiment displayed in FIG. 1 comprises furthermore a block, in particular a retaining pawl actuator 22 that can be activated by a supervisory person during use of the hand gun simulator. The retaining pawl actuator 22 activates a retaining pawl that prevents the tripping squares 17 from releasing the coupling 12 in the stressed position II. A firearm malfunction can thereby be simulated. The control signal for the retaining pawl actuator 22 can for example be transmitted via a wireless communication connection from an external control unit to the hand gun simulator.

In general a modified mechanism can also be used as a block. Such a modified blocking mechanism is for example detected by a sensor that controls an actuator. This also permits adapting the response of the trigger to different simulators or conditions. Such mechanical decoupling of the trigger also prevents an accidental triggering that otherwise can occur during vibrations.

Due to the compact construction of the recoil impulse generator in the front section of the barrel 7 there is sufficient construction space, as is evident from FIGS. 1 and 3, to mount a target acquisition unit 23 there, whose details are however not of importance for the recoil impulse generator.

Figure 5:
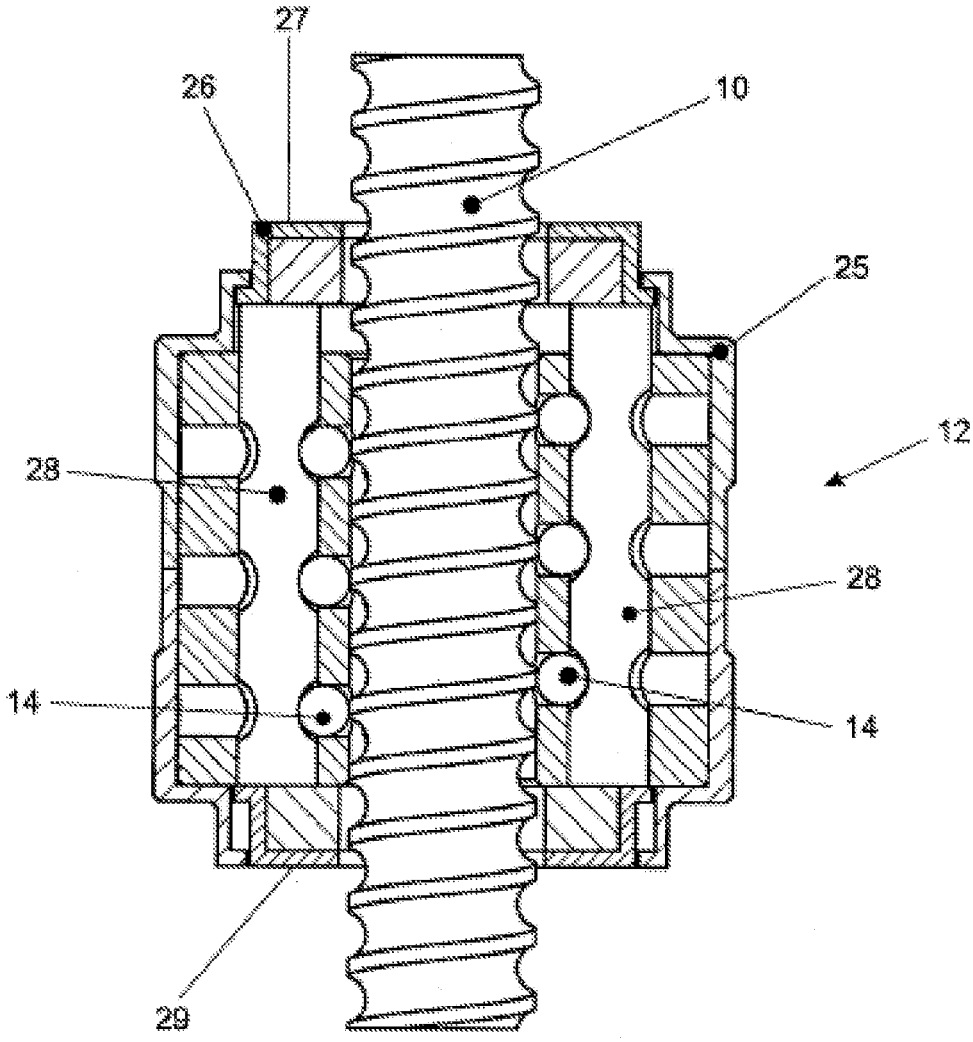
FIG. 5 is a cut view of the coupling.

FIG. 5 displays an embodiment of the coupling 12 in a cross sectional view in detail. The coupling 12 has a coupling housing 25 in which an axially displaceable coupling group 26 is inserted. The coupling in the engaged state engages the spindle 10 with spheres 14, as was already mentioned above. For this purpose the side 27 of the coupling group oriented toward the unstressed position I abuts against a stop (engaging means) in this unstressed position II, so that the coupling group 26 is axially displaced. This effects the displacement of for example eight activation pins 28 that are disposed in parallel to the spindle 10 in the coupling in a manner distributed across the circumferential extent. As a result the spheres 14 are pressed into the helical groove of the spindle 10, whereby the coupling is placed into the coupled state and propelled into an axial motion by the rotating spindle. As soon as the coupling 12 has reached the stressed position II, it again abuts against a stop (disengaging means) with the side 29 of the coupling group 26 that is facing said position II. The displacement pins 28 are moved in the opposite direction so that the spheres 14 leave the helical groove and the coupling is placed into the disengaged state. An important advantage of the coupling is the possibility of engaging with the spindle 10 rotating under full load, which supports a high cadence.

In order to keep abrasions of the coupling, which accelerate wear, to a minimum, it is particularly useful to dispose several spheres 14 in the coupling that simultaneously engage the spindle 10 during coupling. To that end the coupling encompasses several groups of spheres 14, as displayed in FIG. 5.

An additional measure for a quick but wear resistant engagement of the coupling is in purposefully incorporating a bearing clearance that permits an axial displacement of the spindle 10, preferably in the range of ½ to 1 of the slope of the helical groove. If the spheres 14 do not fall into the groove bottom at the moment of engagement but impinge for example on the front face of the flank that points toward the outside, the spindle 10 can axially make way because of the clearance, so that the optimal engagement of the coupling is established as quickly as possible. This also serves to accelerate the coupling process. The spindle can be returned by a spring into the axial starting position after the disengagement.

The invention claimed is:

1. A recoil impulse generator for a weapon simulator comprising a force storage element, and an impulse mass that can be moved and that is moved from a stressed to an unstressed position when a triggering element is actuated by the force storage element in order to simulate a recoil impulse, wherein the recoil impulse generator encompasses furthermore:

a drive that propels a spindle to rotate during a shot sequence that simulates several shots;

a coupling that is connected with the impulse mass and the force storage element and that engages the spindle in the engaged state and is moved through the rotation of the spindle along the same in order to convey the impulse mass into the stressed position against the force applied by the force storage element;

a disengagement means that switches the coupling into a disengaged state when the impulse mass has reached the stressed position; and an engagement means that switches the coupling into an engaged state when the impulse mass has reached the unstressed position.

2. The recoil impulse generator according to claim 1, wherein the drive is an electric motor that is coupled to the spindle.

3. The recoil impulse generator according to claim 2, further comprising a transmission, wherein the electric motor is coupled to the spindle via the transmission that varies the rotational speed.

4. The recoil impulse generator according to claim 1, wherein a first sensor is disposed that detects whether the coupling has left the stressed position and generates a first sensor signal, wherein the generated first sensor signal is used to accelerate the drive from the idle rotational speed.

5. The recoil impulse generator according to claim 1, wherein it comprises a tripping means that, after the disengagement, initially holds the coupling in the stressed position and releases the same during the activation of the triggering element in order to transition to the unstressed position.

6. The recoil impulse generator according to claim 5, wherein it comprises a blocking mechanism that can be pivoted by a blocking mechanism actuator into a blocking position, in which it blocks the tripping means in order to prevent the release of the coupling.

7. The recoil impulse generator according claim 1, wherein the impulse mass is formed by a slide and the coupling that is coupled thereto.

8. The recoil impulse generator according to claim 7, wherein it comprises a slide stop that can be pivoted into a catch position by a catch actuator in order to lock the slide in the stressed position.

9. The recoil impulse generator according to claim 1, wherein the coupling comprises a coupling group with at least one engagement element that engages the spindle in the engaged state.

10. The recoil impulse generator according to claim 9, wherein the coupling comprises several coupling spheres that are disposed in a circumferentially distributed manner relative to the axis of the spindle.

11. The recoil impulse generator according to claim 1, wherein in the shooting direction, the stressed position of the slide is located in front of the unstressed position.

12. The recoil impulse generator according to claim 1, wherein the force storage element is a coil spring wherein the spindle is disposed in the axis thereof.

13. The recoil impulse generator according to claim 1, wherein the components thereof are disposed in the weapon simulator in such a manner that the front section of a barrel is available for the installation of a target-finding or target-acquisition unit.

14. The recoil impulse generator according to claim 1, wherein the disengagement means is formed by a stop that switches the coupling into the disengaged state during the placement in the stressed position.

15. The recoil impulse generator according to claim 1, wherein the engagement means is formed by a stop that switches the coupling into the engaged state during the placement in the unstressed position.

16. The recoil impulse generator according to claim 1, wherein the spindle is supported with an axial clearance that permits an axial displacement of the spindle during the moment of the engagement of the coupling.

* * * * *